US008499507B1

(12) United States Patent
Saccoccio et al.

(10) Patent No.: US 8,499,507 B1
(45) Date of Patent: Aug. 6, 2013

(54) SWIMMING POOL STEP ASSEMBLY

(75) Inventors: Mitch Saccoccio, Clarksville, VA (US); Jonathan Bonelli, New York, NY (US); Reza Afshar, Westlake Village, CA (US)

(73) Assignee: Asia Connection LLC, New York, NY (US)

( * ) Notice: Subject to any disclaimer, the term of this patent is extended or adjusted under 35 U.S.C. 154(b) by 0 days.

(21) Appl. No.: 13/418,612

(22) Filed: Mar. 13, 2012

(51) Int. Cl.
*E04F 11/00* (2006.01)

(52) U.S. Cl.
USPC ..... 52/182; 52/183; 182/82

(58) Field of Classification Search
USPC ..... 52/182–184; 182/82, 84
See application file for complete search history.

(56) References Cited

U.S. PATENT DOCUMENTS

| | | | | |
|---|---|---|---|---|
| 2,278,894 | A * | 4/1942 | Paulson | 446/117 |
| 4,599,835 | A | 7/1986 | Rinke | |
| 4,848,515 | A | 7/1989 | Rinke | |
| 5,176,596 | A * | 1/1993 | Ullman | 482/52 |
| 5,354,247 | A * | 10/1994 | Wilkinson | 482/52 |
| 6,419,611 | B1 * | 7/2002 | Levine et al. | 482/53 |
| 6,966,405 | B2 * | 11/2005 | St-Pierre et al. | 182/93 |
| 7,520,840 | B2 * | 4/2009 | Shifferaw | 482/52 |

* cited by examiner

*Primary Examiner* — Jeanette E Chapman
*Assistant Examiner* — Daniel Kenny
(74) *Attorney, Agent, or Firm* — Dilworth & Barrese, LLP.

(57) ABSTRACT

A swimming pool step assembly includes a plurality of steps which can be stacked in a vertical array including a top step, bottom step and, optionally one or more intermediate steps between the top step and the bottom step, each step having a top surface, a periphery, and a bottom, wherein the bottoms of at least the bottom step and the intermediate step(s) each include a recess configured to receive an adjacent higher step in the vertical array.

24 Claims, 3 Drawing Sheets

SWIMMING POOL STEP ASSEMBLY

BACKGROUND

1. Field of the Invention

The present invention relates generally to accessories for swimming pools and more specifically to a step assembly which can be positioned in a swimming pool to facilitate entry and exit therefrom.

2. Background of the Art

Swimming pool steps are known in the art. For example, U.S. Pat. No. 4,599,835 is directed to an insertable swimming pool step assembly and discloses a frame having a plurality of steps connected in an end-to-end fashion which rests on the bottom of the pool and adjacent to a pool sidewall. An adjustable adapter step is connected near the top of the frame and overlaps a top rail of the pool sidewall. A ballast box is located near the bottom of the frame beneath a lower step to prevent the frame from floating in the water. A pair of hand rails are provided which extend above the steps on both sides of the frame to allow ease of entry and exit into the water. A cushioned strip is provided along the bottom and sides of the frame to guard against tears in a pool liner.

U.S. Pat. No. 4,848,515 is directed to a portable swimming pool step device and discloses a portable, foldable swimming pool step device which includes a pair of sectional stiles interconnected by transverse steps and provided with sectional handrail structures. The stiles, steps, and handrail structures are formed of a thermoplastic material. Each stile include a pair of sections hingedly connected together and foldable between an extended operative position and a folded position. The steps are adjustable to permit the swimming pool step device to function as an inclined ramp. Suitable rollers are mounted on the stiles to permit easy movement of the swimming pool step device when the ladder is in the folded position.

Various other swimming pool step assemblies are commercially available. However, shipping and assembly of the step assemblies remains a problem. What is needed is a swimming pool step assembly, which can be shipped by less expensive carriers (e.g., UPS) and handled in a small package and easily assembled by the consumer.

SUMMARY

A swimming pool step assembly is provided herein, which comprises a plurality of steps which can be stacked in a vertical array including a top step, bottom step and, optionally one or more intermediate steps between the top step and the bottom step, each step having a top surface, a periphery, and a bottom, wherein the bottoms of at least the bottom step and the intermediate step(s) each include a recess configured to receive an adjacent higher step in the vertical array.

BRIEF DESCRIPTION OF THE DRAWINGS

Various embodiments are described below with reference to the drawings wherein.

DETAILED DESCRIPTION OF PREFERRED EMBODIMENT(S)

The swimming pool step assembly of the invention has a segmented construction of easily assembled and disassembled components which can be nested into one another to provide for convenient shipping. The components can preferably be fabricated from a non-buoyant high strength polymeric material. A suitable material for fabricating the swimming pool step assembly of the invention includes injection molded acrylonitrile-butadiene-styrene polymer ("ABS"). Injection molded ABS is far superior to blow molded alternative plastics as it is highly resistant to sagging and flexing.

Figure 1:
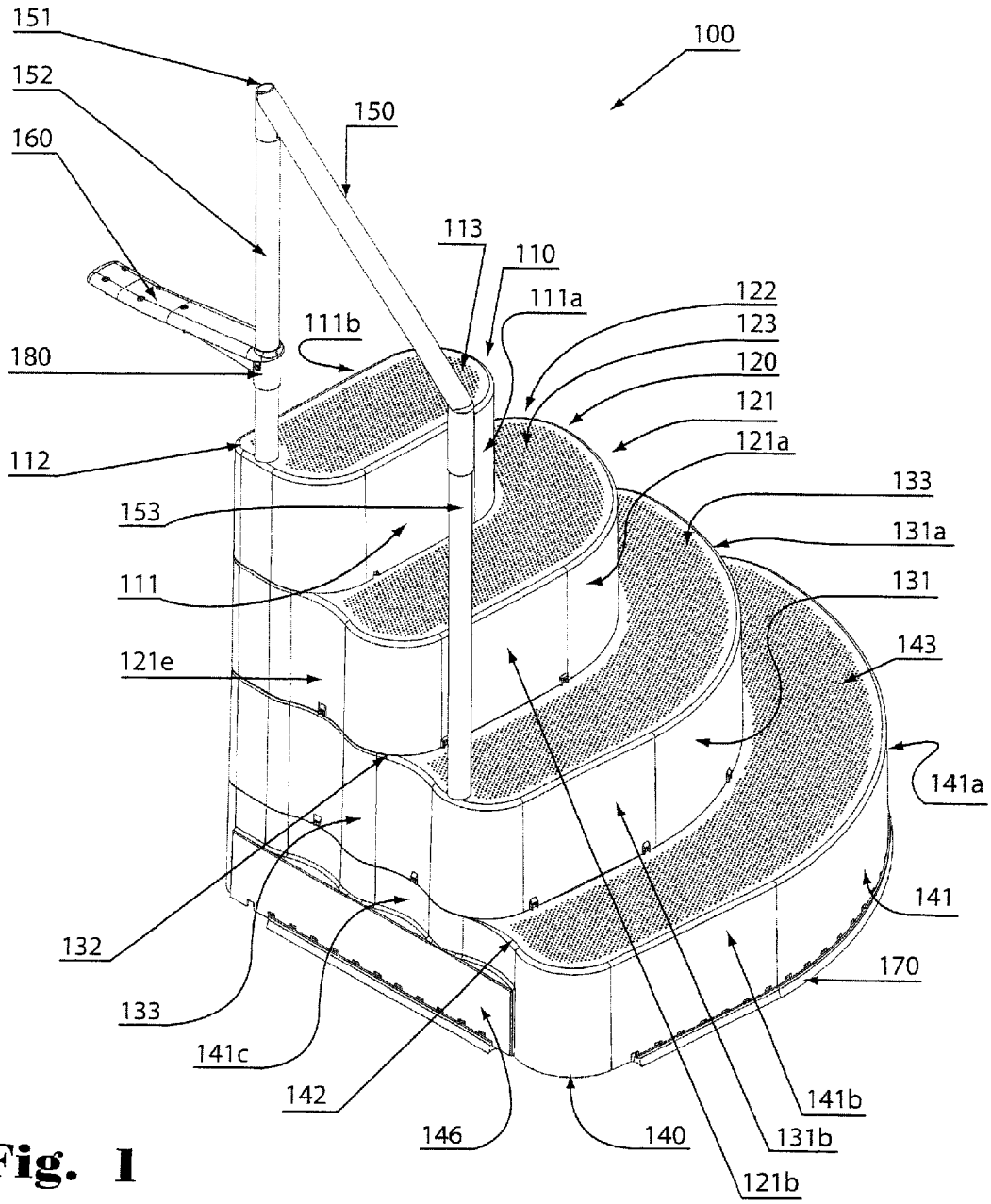
FIG. 1 is a perspective view of the swimming pool step assembly of the invention.
Figure 2:
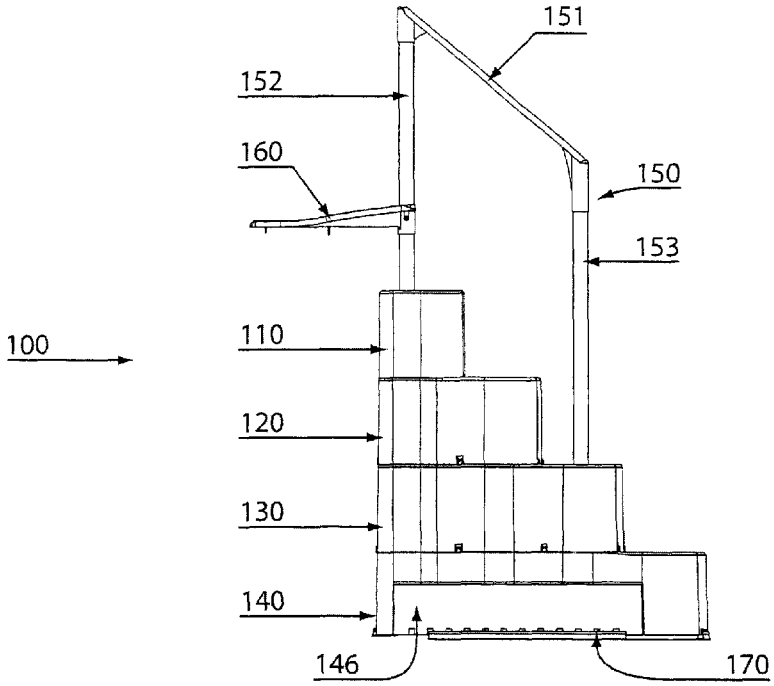
FIG. 2 is a side elevational view of the swimming pool step assembly.

Referring now to FIG. 1, the assembled swimming pool step assembly of the invention is illustrated in perspective view.

The swimming pool step assembly 100 includes a plurality of steps which can be vertically stacked and positioned within a swimming pool. The assembly 100 preferably can include two or more steps. The surfaces of the steps are preferably ventilated by a plurality of perforations to permit pool chemicals to enter the steps and reduce the growth of algae. By way of illustration four steps are shown in FIG. 1. Typically, the pool step assembly can include from two to five steps, although any suitable number of steps can be included depending upon the depth of the pool where the step assembly 100 is installed. The steps are preferably fabricated from injection molded ABS polymer and are not buoyant. Therefore, they do not need to be weighted down to remain positioned within the pool water.

As shown in FIG. 1, the top step 110 includes a top surface 112, which includes slip resistant treads and/or perforations 113. Outer periphery 111 includes a curved portion 111*a* and a linear side 111*b*. Top step 110 also includes a vertical channel 116 (FIG. 4) configured and dimensioned to slidingly receive a support bar 152 of the hand rail assembly 150 (described more fully below). The top step 110 rests upon the top of the second step 120 when the step assembly 100 is assembled for use.

The second step 120 includes a top surface 122 with slip resistant treads and/or perforations 123. Outer periphery 121 includes a curved portion 121*a*, a linear side 121*b* and an undulate surface 121*c*. The second step 120 rests upon the top of third step 130, when the step assembly 100 is assembled for use.

The third step 130 includes a top surface 132 with slip resistant treads and/or perforations 133. Outer periphery 131 includes a curved portion 131*a*, a linear side 131*b* and an undulate surface 131*c*. The third step 130 also includes a vertical channel 136 (FIG. 4) configured and dimensioned to slidingly receive a support bar 153 of the hand rail assembly 150. Third step 130 rests upon the top of fourth step 140 when the step assembly 100 is assembled for use.

The fourth and bottom step 140 includes a top surface with slip resistant treads and/or perforations 143. Outer periphery 141 includes a curved portion 141*a*, a linear side 141*b*, and an undulate surface 141*c* at least partially covered by a side panel 146. Beneath bottom step 140 is a foam base insert 170 to prevent the sliding of the pool assembly 100 on the floor of the swimming pool. The foam base 170 also protects and removably adheres to the pool liner.

The step assembly 100 further includes a hand rail assembly 150, which includes a hand rail 151 mounted at an upper end to vertical support bar 152 and at a lower end to vertical support bar 153. As mentioned above, support bar 152 is removably disposed within channel 116 in the top step, and support bar 153 is removably disposed within channel 136 in the third step 130. Support bars 152 and 153 can be of tubular structure having a hollow bore. The handrail assembly 150 can be fabricated from metal such as aluminum or stainless steel, or an engineering plastic such as polycarbonate, polyvinylchloride (PVC), ABS, and the like.

A brace 160 is fixedly attached to the support tube 152 by connectors 180 which can include nuts, bolts, washers, etc. Brace 160 extends laterally from support tube 152 and comprises a mounting bracket for attachment to the deck surrounding the swimming pool.

Figure 3:
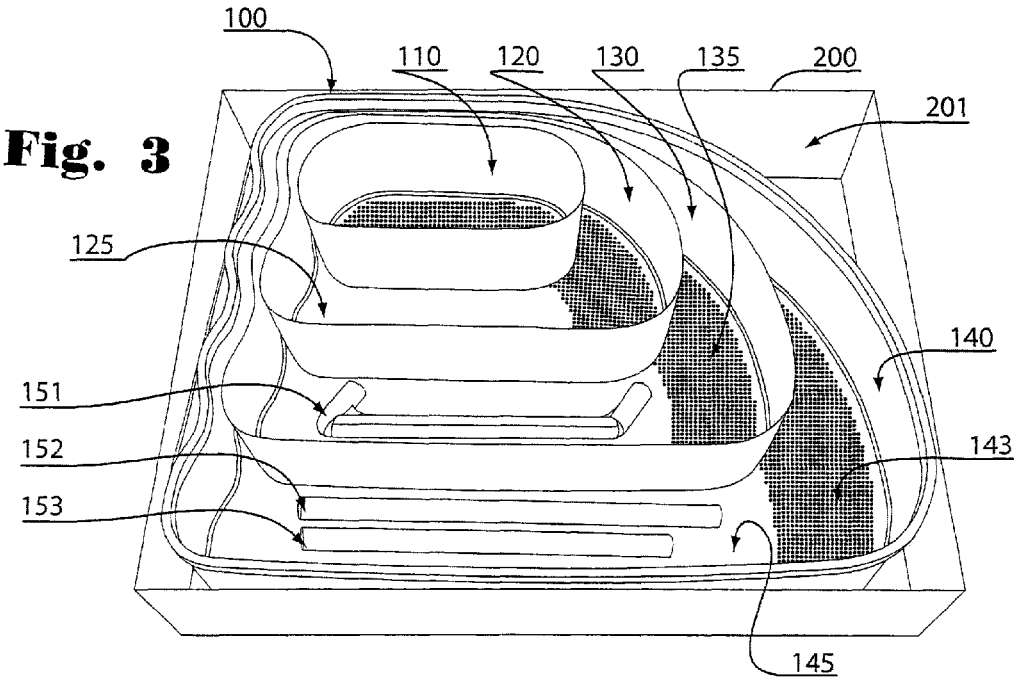
FIG. 3 is a bottom perspective view of the swimming pool step assembly in a nested configuration and stored in a shipping container.

Referring now to FIG. 3, the pool assembly 100 is shown in a nested configuration, which is suitable for shipping in a compact shipping container 200. The box container 200 includes an interior space 201 for containing the swimming pool step assembly 100, and optionally an openable lid or flap(s) (not shown). The step assembly 100 can be removed and easily assembled by the consumer for placement in a swimming pool. The bottom 144 of the fourth step 140 includes a recess 145, which is configured to accommodate and receive the third step 130. The bottom 134 of the third step includes a recess 135 to accommodate and receive the second step 120. And the bottom 124 of the second step includes a recess 125 to accommodate and receive the first step 110. The disassembled hand rail assembly can be disposed within one or more recesses, e.g., 145 and/or 135, for shipping.

Figure 4:
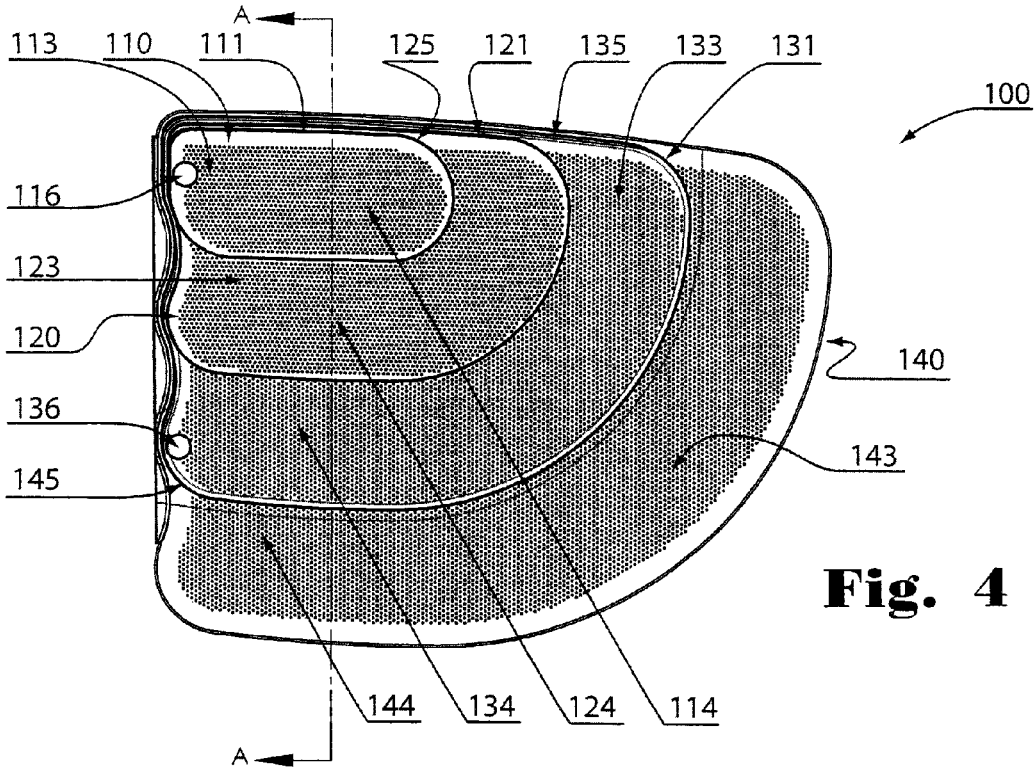
FIG. 4 is a bottom plan view of the swimming pool step assembly.
Figure 5:
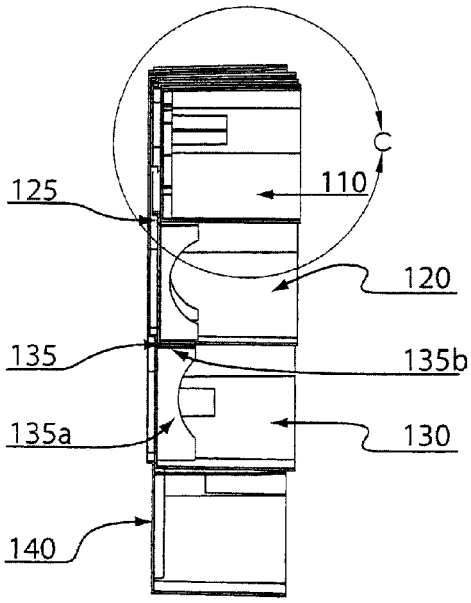
FIG. 5 is a sectional view taken along lines A-A of FIG. 4.
Figure 6:
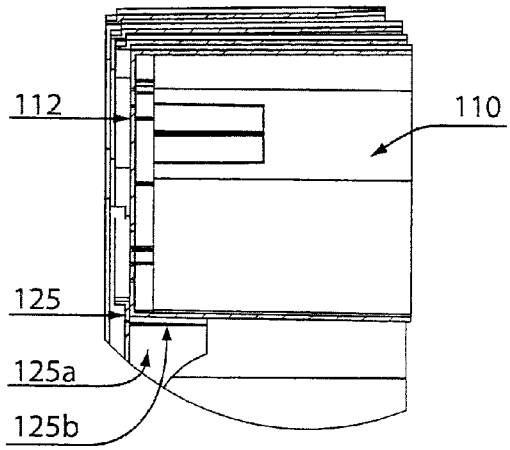
FIG. 6 is a detailed expanded view of section C of FIG. 5.

Referring now to FIGS. 4 to 6. in an embodiment of the invention, recess 145 is configured to closely conform to the shape of the outer periphery 131 of the third step such that the third step 130 can nest securely in the bottom 144 of the fourth step 140.

The bottom 134 of the third step 130 includes a recess 135 which is configured to closely conform to the shape of the outer periphery 121 of the second step such that the second step 120 can nest securely in the bottom 134 of the third step 130. Recess 135 is at least partially defined by a wall 135*b*, which is joined to a panel 135*a* at a corner, as shown in FIG. 5.

Recess 125 in the bottom 124 of the second step 120 is configured to closely conform to the shape of the outer periphery 111 of the first step 110 such that the first step 110 can nest securely in the bottom 124 of the second step 140. Recess 125 is at least partially defined by wall 125*b*, which is joined to a panel 125*a* at a corner, as shown in FIGS. 5 and 6.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A swimming pool step assembly comprising:

at least two steps which can be stacked in a vertical array including a top step, bottom step and, optionally one or more intermediate steps between the top step and the bottom step, each step having a top surface, a periphery, and a bottom, wherein the bottoms of at least the bottom step and the intermediate step(s) each include a recess configured to receive an adjacent higher step in the vertical array, wherein said steps include a multitude of perforations on the top surfaces thereof.

2. The swimming pool step assembly of claim 1 which can be configured in a nested arrangement wherein the intermediate step(s) are disposed in the recess in the bottom of the bottom step, and the top step is disposed in the recess in the bottom of an uppermost one of the intermediate step(s).

3. The swimming pool step assembly of claim 2 comprising two or three intermediate steps.

4. The swimming pool step assembly of claim 1 which can be configured in a stacked arrangement wherein the intermediate step(s) are positioned on top of the bottom step, and the top step is positioned on top of the intermediate step(s).

5. The swimming pool step assembly of claim 4 including two or three intermediate steps.

6. The swimming pool step assembly of claim 1 further including a handrail assembly.

7. The swimming pool step assembly of claim 6 wherein the handrail assembly includes a handrail and two vertical support bars.

8. The swimming pool step assembly of claim 7 wherein the handrail assembly is fabricated from a material selected from the group consisting of aluminum, stainless steel, polycarbonate, polyvinyl chloride and ABS.

9. The swimming pool step assembly of claim 7 further including a brace extending laterally from a vertical support bar.

10. The swimming pool step assembly of claim 1 wherein the plurality of steps are each fabricated from injection molded ABS.

11. The swimming pool step assembly of claim 1 wherein said at least two steps include only a top step and a bottom step, which can be configured in a nested arrangement wherein the top step is disposed in a recess in the bottom of the bottom step.

12. A swimming pool step assembly comprising:

first, second, third and fourth steps, wherein said first step has a smaller configuration than the second step, the second step has a smaller configuration than the third step, and the third step has a smaller configuration than the fourth step, wherein each of said steps include a multitude of perforations on respective top surfaces thereof, wherein said steps can be positioned in a stacked arrangement wherein the first step is on top of the second step, the second step is on top of the third step and the third step is on top of the fourth step such that the first step is the uppermost step and the fourth step is the lowest step, and wherein the steps can alternatively be positioned in a nested arrangement wherein the first step, second step and third step are nested within the fourth step.

13. The swimming pool step assembly of claim 12 wherein the fourth step has a bottom with a recess configured and dimensioned to receive the third step, the third step has a bottom with a recess configured and dimensioned to receive the second step, and the second step has a bottom with a recess configured to receive the first step, such that when the steps are in a nested arrangement, the third step is disposed within the recess of the fourth step, the second step is disposed within the recess of the third step, and the first step is disposed within the recess of the second step.

14. The swimming pool step assembly of claim 12 wherein the recess in the fourth step is defined by a wall configured to closely conform to a periphery of the third step, the recess in the third step is defined by a wall configured to closely conform to a periphery of the second step, and the recess in the second step is defined by a wall configured to closely conform to a periphery of the first step.

15. The swimming pool step assembly of claim 12 further including a handrail assembly.

16. The swimming pool step assembly of claim 15 wherein the handrail assembly includes a handrail, a first vertical support bar and a second vertical support bar.

17. The swimming pool step assembly of claim 16 wherein, when the swimming pool step assembly is in a stacked configuration, a bottom portion of the first vertical support bar is disposed within a vertical channel in the first step and a bottom portion of the second vertical support bar is disposed within a vertical channel in the third step.

18. The swimming pool step assembly of claim 15, wherein the handrail assembly is fabricated from a material selected from the group consisting of aluminum, stainless steel, polycarbonate, polyvinyl chloride and ABS.

19. The swimming pool step assembly of claim 17 further including a brace extending laterally from the first vertical support bar.

20. The swimming pool step assembly of claim 12 wherein the steps are each fabricated from injection molded ABS.

21. A shipping container enclosing the swimming pool step assembly of claim 1 in the nested arrangement.

22. A shipping container enclosing the swimming pool step assembly of claim 12 in the nested arrangement.

23. The swimming pool step assembly of claim 1 further including a foam base insert for positioning underneath the bottom step.

24. The swimming pool step assembly of claim 12 further including a foam base insert for positioning underneath the lowest step when the step assembly is in the stacked arrangement.

* * * * *